United States Patent [19]

Noritake et al.

[11] 4,347,219

[45] Aug. 31, 1982

[54] CATALYTIC CONVERTER FOR EXHAUST-GAS CLEANING USE AND METHOD OF ASSEMBLING SAME

[75] Inventors: Yutaka Noritake, Kawagoe; Ikuo Kajitani, Hanno; Sakuji Arai, Ageo; Toshiaki Muto, Kamifukuoka, all of Japan

[73] Assignee: Honda Giken Kogyo Kabushiki Kaisha, Tokyo, Japan

[21] Appl. No.: 220,145

[22] Filed: Dec. 23, 1980

[30] Foreign Application Priority Data

Dec. 29, 1979 [JP] Japan ..... 54-172154
Dec. 29, 1979 [JP] Japan ..... 54-182816[U]

[51] Int. Cl.[3] ..... F01N 3/28

[52] U.S. Cl. ..... 422/180; 29/157 R; 29/450; 29/525; 60/299; 422/179

[58] Field of Search ..... 422/179, 180, 219, 221, 422/222; 29/157 R, 446, 450, 525; 60/299

[56] References Cited

U.S. PATENT DOCUMENTS 4,043,761 8/1977 Gaysert et al. ..... 422/179
4,093,423 6/1978 Neumann ..... 29/157 R X
4,155,980 5/1979 Santiago et al. ..... 422/179 X
4,163,041 7/1979 Gaysert ..... 422/179
4,239,733 12/1980 Foster et al. ..... 422/179

*Primary Examiner*—Richard L. Chiesa
*Attorney, Agent, or Firm*—Armstrong, Nikaido, Marmelstein & Kubovcik

[57] ABSTRACT

The converter casing includes a hollow cylindrical body in which a monolithic catalyst substrate is supported by a wire-mesh cushioning element. Secured to the casing body are a pair of holding fixtures which are each fitted with an end cushioning element engageable with the adjacent end face of the catalyst substrate to hold the latter against axial displacement. The casing body includes a smaller-diameter portion, at least one larger-diameter portion and a sloped shoulder portion interposed therebetween. The holding fixtures are fixed to the larger-diameter or other end portions of the casing body in spaced relation to the cushioning element held between the catalyst substrate and the casing body. Such casing structure reduces the danger of the catalyst substrate being damaged or broken under vibration or shock to a minimum thereby to enhance the durability of the substrate and enables realization of a particularly compact and inexpensive catalytic converter.

8 Claims, 5 Drawing Figures

CATALYTIC CONVERTER FOR EXHAUST-GAS CLEANING USE AND METHOD OF ASSEMBLING SAME

BACKGROUND OF THE INVENTION

1. Field of the Invention

This invention relates to catalytic converters for exhaust-gas cleaning use, such as usable on the exhaust duct of a vehicular internal-combustion engine, and to methods of assembling same.

2. Description of the Prior Art

Generally, in a catalytic converter for vehicular use including a monolithic catalyst substrate, it is required that the substrate, which is relatively brittle in nature, be supported in the converter casing in shock-absorbing fashion so as not to be broken or damaged even under vibration or mechanical shock. This permits the catalytic converter to serve the intended cleaning function for an extended period of time while at the same time enabling it to be formed as compact as possible.

Conventionally, however, a catalytic converter of the type described includes, as illustrated in FIG. 4, a casing C' having a hollow cylindrical form of body 01 which is straight having the same diameter over the whole length thereof and in which a catalyst substrate 08, covered with a wire-mesh cushioning element 09 around the periphery thereof, is inserted while radially compressing the cushioning element. The catalyst substrate 08 inserted in casing body 01 and supported therein by cushioning element 09 is held axially in place by a pair of holding fixtures 011 fixed to the casing body and each fitted with an end cushioning element 010, which is engageable with the adjacent end face of catalyst substrate 08. With this construction, however, insertion into the casing body of the catalyst substrate 08 covered with cushioning element 09 has been more or less difficult and the cushioning element 09 has tended to be compressed to a higher density in its end regions (particularly in its forward end region with respect to the direction of insertion) than in the remaining intermediate region thereof. This means local increase in surface pressure acting on the catalyst substrate 08 and, when the catalytic converter is subjected to vibration or mechanical shock, local stress concentration may arise in the end regions of catalyst substrate 08 (particularly in its forward end region with respect to the direction of insertion), often causing damage or breaking of the catalyst substrate, which is brittle in nature.

Further, as the catalytic converter is subjected to repeated vibration or shock, the high-density end regions of cushioning element 09 gradually spread out axially outward and, coming into pressure contact with the end cushioning elements 010, force the latter outwardly thus to cause endwise play of the catalyst substrate 08 and hence early breakage thereof. As a measure to overcome this difficulty, it may be contemplated to provide between each end of cushioning element 09 and adjacent one of end cushioning elements 010 a space enough to keep these elements from abutting against each other. Such arrangement, however, must incur another sort of disadvantage of increase in total length and size of the casing C'.

A catalytic converter of the form described above has generally been assembled by the method which will be described below with reference to FIG. 5. In the figure, an insertion jig J' is shown fitted over one end of the straight form of hollow cylindrical casing body 07 and has an outwardly divergent flaring bore or opening whose smallest diameter A' is smaller than the inside diameter B' of casing body 07. The catalyst substrate 08, covered around the periphery thereof with cushioning element 09, is inserted axially through the insertion jig J' into the casing body 01 so as to be supported in the latter. In such conventional assembling method, however, the cushioning element 09 must be compressed by the insertion jig J' in excess of the amount of compression normally required. This means an undesirable increase in resistance to insertion of the catalyst substrate which causes certain assembling problems. Particularly, where the outside diameter of catalyst substrate 08 is held to a substantial tolerance, there is the danger of the catalyst substrate being broken at the time of its insertion into the jig J'. In addition, the unduly large insertion resistance must result in various assembling defects including dislocation of cushioning element 09 in relation to the catalyst substrate 08, nonuniformity in contact length of cushioning element 09 with the catalyst substrate, and early fatigue of cushioning element 09, which in combination incur early breakage of the brittle catalyst substrate 08.

SUMMARY OF THE INVENTION

The present invention has for its primary object the provision of a catalytic converter for exhaust-gas cleaning use which is designed to overcome the difficulties previously encountered as described above and is simple in structure.

A specific object of the present invention is to provide a catalytic converter of the character described which is designed to minimize the danger of the catalyst substrate being damaged or broken even under vibration or mechanical shock thereby to enhance the durability of the catalyst substrate and which is compact in size and inexpensive.

Another object of the present invention is to provide a method of assembling a catalytic converter for exhaust-gas cleaning use which is capable of minimizing the danger of the catalyst substrate being broken in the assembling operation and also of improving the durability of the catalyst substrate.

The above and other objects and advantages of the present invention will become apparent from the following description when taken in conjunction with the accompanying drawings, which illustrate a few preferred embodiments of the invention.

DESCRIPTION OF THE PREFERRED EMBODIMENTS

Figure 1:
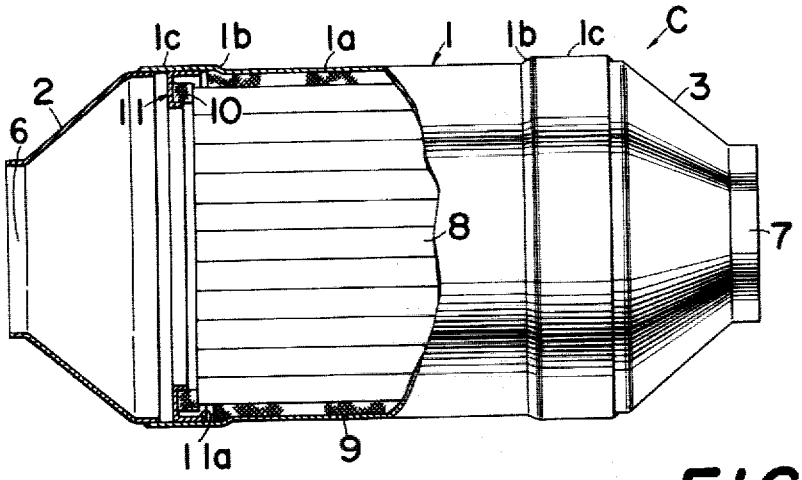
FIG. 1 is a side view, partly in longitudinal cross section, of a preferred form of catalytic converter embodying the principles of the invention.

Referring to FIG. 1, which illustrates a preferred embodiment of the present invention, reference character C indicates the casing of the catalytic converter, which is comprised of a hollow cylindrical casing body 1, including a smaller-diameter cylindrical portion 1*a*, a pair of larger-diameter cylindrical portions 1*c* and a pair of sloped shoulder portions 1*b* each interconnecting one of the larger-diameter cylindrical portions 1*c* and the adjacent end of the smaller-diameter cylindrical portion 1*a* and oriented so as to be outwardly divergent, and a pair of truncated conical casing end sections 2 and 3 connected as by welding with the respective larger-diameter cylindrical portions 1*c* of casing body 1 and defining a gas inlet opening 6 and a gas outlet opening 7, respectively. Inserted in the casing body 1 through one end opening thereof prior to the welding of the casing end sections 2 and 3 to the casing body 1 is a cylindrical-shaped monolithic catalyst substrate 8 which is of honeycomb structure and covered around the periphery thereof with a tubular cushioning element 9 formed of wire mesh. The catalyst substrate 8 is inserted so as to be supported in the smaller-diameter portion 1*a* of casing body 1 through the medium of the cushioning element 9, which is radially compressed to an appropriate extent and presented at the opposite ends to the larger-diameter portions 1*c* of casing body 1.

The catalyst substrate 8 so inserted is held against axial movement with its opposite end faces engaged by respective end cushioning elements 10, which are fitted in a pair of annular holding fixtures 11 secured to the casing body 1. The holding fixtures 11 are channel-shaped in cross section and the outer flange section 12 of each fixture 11 is welded to the inner peripheral surface of the adjacent larger-diameter portion 1*c* of casing body 1 and extends axially inwardly of the casing body 1 beyond the inner end face of the end cushioning element 10 fitted in the channel of the fixture 11, as shown.

Figure 2:
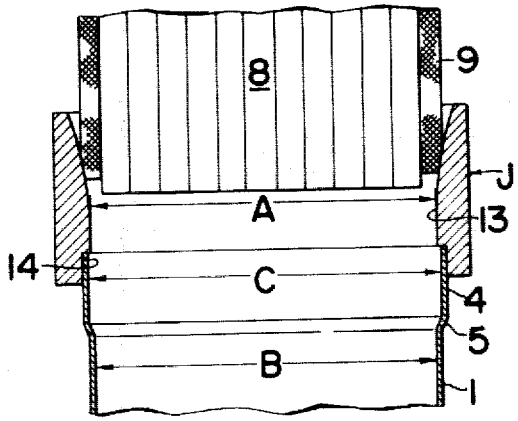
FIG. 2 is a cross-sectional view explanatory of the procedure of inserting the catalyst substrate into the converter casing according to the method of the present invention.

Description will next be made of the sequence of assembling the catalytic converter of the present invention with reference to FIG. 2.

Reference character J indicates an insertion jig applied to the casing body 1 at one end thereof for insertion therein of the catalyst substrate 8 together with its covering cushioning element 9. The insertion jig J is of annular form with its inner wall surface flared to define an insertion opening 13 whose diameter increases along its axis from its minimum at the base end of the opening toward the tip end thereof. The minimum diameter A is determined so as to be larger than the inside diameter B of the smaller-diameter portion 1*a* of casing body 1 and smaller than that C of the larger-diameter portion 1*c* thereof, i.e., in the relationship of $B<A<C$. The insertion jig J is formed as its base end around the inner periphery thereof with an annular recess 14 for fitting engagement with the larger-diameter portion 1*c* of casing body 1.

In assembling operation, first the insertion jig J is connected at its base end to the casing body 1 by fitting the recessed base end over the outer end of the larger-diameter portion 1*c* of casing body 1. Then, the catalyst substrate 8, covered with cushioning element 9 around the periphery thereof, is inserted through the flared insertion opening 13 of insertion jig J into the casing body 1. In the process of insertion, the cushioning element 9 encircling the catalyst substrate 8 first enters the larger-diameter portion 1*c* while being radially inwardly compressed by the flared inside wall surface of the insertion jig J and is then inserted into the smaller-diameter portion 1*a* of casing body 1 while being secondarily compressed by the sloped shoulder portion 1*b* so that the catalyst substrate 8 is supported resiliently in the smaller-diameter body portion 1*a* by the tubular cushioning element 9.

Subsequently, the annular end-holding fixtures 11, channel-shaped in cross section and fitted with annular end cushioning element 10, are fixed as by welding to the inner peripheral surfaces of the respective larger-diameter portions 1*c* of casing body 1 in the manner described hereinbefore and shown in FIG. 1. Finally, truncated conical end sections 2 and 3 of the casing C are welded to the opposite ends of the casing body 1 to complete the assembling of the catalytic converter.

Though in the embodiment described above the casing body 1 has been described as formed at each of its opposite ends with a larger-diameter portion 1*c*, it will be readily understood that, if desired, the casing body 1 may be formed only at one end thereof with such larger-diameter portion 1*c*.

As described hereinbefore, the tubular cushioning element 9, covering the catalyst substrate 8 around the periphery thereof is primarily compressed by the insertion jig J before it is actually advanced into the casing body 1 and then secondarily compressed by the sloped shoulder portion 1*b* of casing body 1 before it is finally inserted in the smaller-diameter portion 1*a* of casing body 1. Such stepwise compression of cushioning element 9 is effective to reduce the insertion resistance of the catalyst substrate 8, covered with the cushioning element, and enables the substrate to be inserted in the casing body 1 with particular ease and efficiency. Further, the danger of the catalyst substrate 8 being broken at the point of time of its insertion into the insertion jig J is effectively obviated even where the diameter of catalyst substrate 8 is held to an ample manufacturing tolerance. In addition, the catalyst substrate 8 inserted is supported resiliently in the casing body 1 in an accurate and stable manner by the cushioning element 9, which is appropriately compressed to fully serve the function of cushioning the catalyst substrate. Specifically, such assembling defects as dislocation of the cushioning element 9 in relation to the catalyst substrate 8, early fatigue of the cushioning element 9 due to any excessive compression, and nonuniformity in contact length of the cushioning element 9 with the catalyst substrate, are obviated and the danger of the substrate 8 being broken early due to such defects are eliminated, enabling substantial increase in service life of the substrate.

Further, the sloped shoulder portion 1*b* extending between the smaller- and larger-diameter portions 1*a* and 1*c* serves as a slip guide for the cushioning element 9 which enables the catalyst substrate 8 to be inserted smoothly into the casing so that the assembling efficiency of the converter unit is substantially improved.

Also, such casing configuration ensures that the cushioning element 9 as finally inserted in the casing is in an axially correct position relative thereto and this makes it possible to fix the end-holding fixtures 11 to the casing in a position as close to the cushioning element 9 as possible without the danger of the fixtures 11 interfering with the latter and thus enables substantial reduction in total length and size of the catalytic converter.

As pointed out previously, the wire-mesh cushioning element 9, covering the catalyst substrate 8, generally tends to become more compact in its front or rear end region than the remaining region thereof as it is inserted together with the catalyst substrate into the casing body 1 while being radially compressed. In this connection, it is to be noted that such local increase in density of the cushioning element 9 is alleviated, according to the present invention, by the fact that the casing body 1 is formed at its opposite ends with larger-diameter portions 1*c*, to which the cushioning element 9 is presented at its opposite ends. Because of this, there arises no stress concentration in the catalyst substrate 8 that may result in damage or breakage thereof.

Further, though the cushioning element 9 is principally radially compressed, the amount of increase in its axial length is minimized even under vibration or mechanical shock to which the catalytic converter is subjected since the end regions of cushioning element 9 presented to the larger-diameter portions 1*c* of casing body 1 are released free to expand radially. This not only makes it possible to weld the holding fixtures 11 to the casing body 1 with their outer flanges 11*a* directed toward the catalyst substrate 8 to further reduce the total length of casing C but also prevents occurrence of any end play or slackness of the catalyst substrate 8 that may result from axial spreading out of the cushioning element 9 and cause damage to the catalyst substrate.

Moreover, the monolithic catalyst substrate 8, formed of ceramic material, is usually held to a relatively large tolerance in outside diameter (for example, of −2.6 mm to +1.6 mm), exhibiting a more or less variation in its diameter. Such variation in diameter of the catalyst substrate can be readily accommodated by selective use of casing bodys 1 prepared in different inside diameters of the smaller-diameter portion 1*a* and having all the same inside diameter of the larger-diameter portion or portions 1*c*. This obviously makes any other casing parts such as end sections 2, 3 and holding fixtures 11 usable in common with the different casing bodies without demanding any dimensional changes in such casing parts and thus enables substantial reduction in fabrication cost of the catalytic converter.

Figure 3:
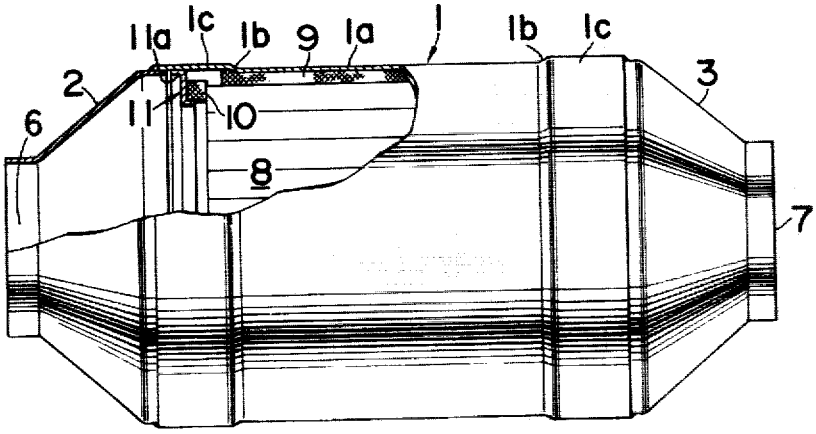
FIG. 3 is a view similar to FIG. 1, showing another form of catalytic converter embodying the present invention.
Figure 4:
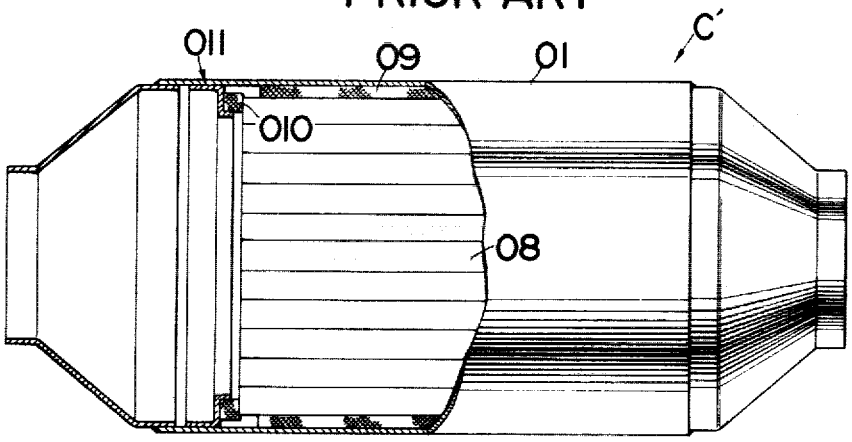
FIG. 4 PRIOR ART
FIG. 4 is a view similar to FIGS. 1 and 3, showing a conventional form of catalytic converter.
Figure 5:
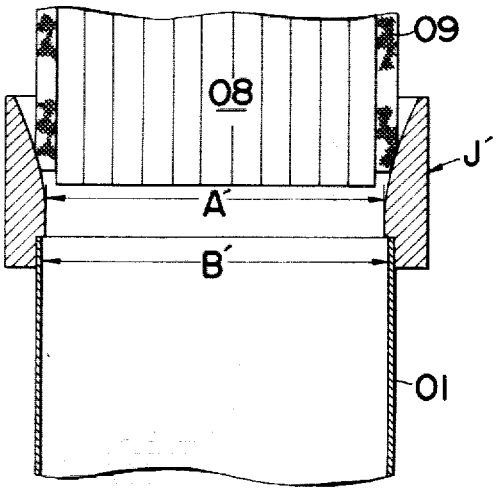
FIG. 5 PRIOR ART
FIG. 5 is a view similar to FIG. 2, showing the procedure of inserting the catalyst substrate into the converter casing according to the conventional assembling method.

Illustrated in FIG. 3 is another preferred embodiment of the present invention in which the holding fixtures 11, serving to hold the catalyst substrate 8 against axial displacement, are substantially Z-shaped in cross section and are each welded to the inner peripheral surface of the adjacent larger-diameter portion 1*c* of casing body 1 with the outer flange section 11*a* directed axially outwardly of the casing body 1. This embodiment is otherwise quite the same as the one previously described and, as will be readily recognized, gives the same successful results.

What is claimed is:

1. In a catalytic converter for exhaust-gas cleaning use in which a monolithic catalyst substrate is supported in a hollow cylindrical casing body by a tubular cushioning element of wire-mesh form and held axially in place by a pair of annular holding fixtures secured to the casing body and each fitted with an end cushioning element for engagement with the adjacent end face of the catalyst substrate, the improvement wherein said casing body comprises an integral cylinder having a smaller-diameter cylindrical portion and a larger-diameter cylindrical portion connected to at least one end of said smaller-diameter cylindrical portion through the medium of a sloped shoulder portion and wherein said tubular cushioning element extends into said larger-diameter cylindrical portion whereby when the monolithic catalyst substrate and the tubular cushioning element surrounding the same are inserted into the casing body, the larger-diameter portion and the sloped shoulder portion gradually compress the tubular cushioning element to facilitate the insertion thereof.

2. The improvement as claimed in claim 1, wherein said casing body further comprises another larger-diameter cylindrical portion connected to the outer end of said smaller-diameter cylindrical portion through the medium of a sloped shoulder portion.

3. The improvement as claimed in claim 1, wherein one of said holding fixtures is secured to said larger-diameter cylindrical portion of said casing body.

4. The improvement as claimed in claim 2, wherein said holding fixtures are secured to the respective larger-diameter cylindrical portions of said casing body.

5. The improvement as claimed in claim 1, 2, 3 or 4, wherein said holding fixtures are spaced apart from said catalyst substrate.

6. The improvement as claimed in claim 1, 2, 3 or 4, wherein said holding fixtures are channel-shaped in cross section.

7. The improvement as claimed in claim 1, 2, 3 or 4, wherein said holding fixtures are Z-shaped in cross section.

8. A method of assembling a catalytic converter for exhaust-gas cleaning use in which a monolithic catalyst substrate is supported in a hollow cylindrical casing body by cushioning means, said method comprising the steps of: forming said casing body with an enlarged-diameter portion at least at one end thereof which is connected with the central straight cylindrical portion of the casing body through the intermediary of a sloped shoulder portion; fitting over said enlarged-diameter portion an insertion jig defining an outwardly divergent flaring insertion opening therein the smallest diameter of which is larger than the inside diameter of the central straight cylindrical portion of the casing body; inserting said catalyst substrate as covered around the periphery thereof with a tubular cushioning element through said insertion opening of said insertion jig into the enlarged-diameter portion of said casing body while subjecting said cushioning element to a primary radial compression; and inserting said catalyst substrate further into said casing body over said sloped shoulder portion while subjecting said cushioning element to a secondary radial compression until said catalyst substrate is held in a predetermined position within said casing body.

* * * * *